US006218344B1

(12) United States Patent
Gschwender et al.

(10) Patent No.: US 6,218,344 B1
(45) Date of Patent: Apr. 17, 2001

(54) ANTIWEAR ADDITIVES FOR SPACECRAFT LUBRICANTS

(75) Inventors: Lois J. Gschwender, Kettering; Carl E. Snyder, Jr., Trotwood, both of OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 09/490,293

(22) Filed: Jan. 21, 2000

(51) Int. Cl.[7] ..... C10M 137/04

(52) U.S. Cl. ..... 508/431; 508/207; 508/591; 558/211; 558/212

(58) Field of Search ..... 508/431; 558/211, 558/212

(56) References Cited

U.S. PATENT DOCUMENTS

| | | | | |
|---|---|---|---|---|
| 2,866,755 | * | 12/1958 | Tierney et al. | 252/47.5 |
| 3,384,686 | * | 5/1968 | Boschan et al. | 260/966 |
| 3,436,441 | * | 4/1969 | Thompson | 260/966 |
| 3,483,129 | * | 12/1969 | Dolle, Jr. et al. | 252/49.9 |
| 3,714,043 | * | 1/1973 | Clark | 252/46.7 |
| 3,865,743 | * | 2/1975 | Sheratte | 252/78 |
| 3,935,116 | * | 1/1976 | Sheratte | 252/78 |
| 5,196,130 | | 3/1993 | Gschwender et al. | 508/431 |

* cited by examiner

*Primary Examiner*—Ellen M. McAvoy
(74) *Attorney, Agent, or Firm*—Charles E. Bricker; Thomas L. Kundert

(57) ABSTRACT

Lubricants for satellite applications consist essentially of a base fluid having low volatility and a minor amount, i.e., about 0.1 to 10 weight percent, of a chlorinated tris (phenoxyphenyl)phosphate.

6 Claims, No Drawings

ANTIWEAR ADDITIVES FOR SPACECRAFT LUBRICANTS

RIGHTS OF THE GOVERNMENT

The invention described herein may be manufactured and used by or for the Government of the United States for all governmental purposes without the payment of any royalty.

BACKGROUND OF THE INVENTION

The present invention relates to improved lubricants for spacecraft.

The use of satellites for communication and navigation is ever increasing in both military and commercial applications. The high costs of building and launching satellites are driving the need to extend the useful life of satellites from the current 5 to 8 years to at least 15 years.

Spacecraft utilize many moving assemblies. The current tribological requirements of such assemblies are usually satisfied by a variety of lubricants and materials. To date, spacecraft lifetime is limited primarily by the failure of systems such as power supplies, electronics, thermal systems, optical systems and positioning systems. Technological advances in these systems are making them more reliable. As spacecraft life expectancy increases, more spacecraft failures will be attributed to tribological limitations if corresponding advances in tribology do not occur.

Lubrication demands on satellite platforms generally fall into three categories: high speed, low speed and mixed speed. Some manufacturers of mechanisms on satellite platforms prefer liquid lubricants while others prefer grease lubricants. Low speed satellite mechanisms operate below the speeds required to produce an elastohydrodynamic lubrication (EHL) film, and thus have metal to metal contact. Such metal to metal contact leads to high wear and eventual mechanism failure. High speed mechanisms operate at speeds where the EHL film is maintained throughout the life of the bearing system. Although the presence of the EHL film minimizes wear, there is still intermittent asperity contact at full speed and high wear during start-up. Mixed speed mechanisms operate at times at high speed and at other times low speed, and are exposed to both EHL and boundary lubrication.

Two factors are critical in maintaining good lubrication in liquid/grease lubricated systems over an extended time, in an extremely high vacuum. First, the lubricant base oil must remain in place, without volatilizing or creeping into other areas, and it must not change in other ways, such as becoming thicker or changing chemically. Second, additives in the lubricant must not evaporate or be consumed, thus leaving the base oil to carry the load with no additive-produced film. New, improved base fluids for satellite applications are much less volatile than previously and currently used mineral oils; these new base fluids, including, but not necessarily limited to narrow molecular weight range polyalphaolefins (PAO), multiply alkylated cyclopentanes (MAC) and silahydrocarbons (SiHC), are gradually being inserted into satellite applications.

Additives also need to have low volatility. Hydrocarbon base lubricants are readily enhanced with a wide variety of additive chemical classes. In atmospheric pressure applications, commercial additives are a mature technology because hydrocarbon base oils have a very large industrial market. One problem for high vacuum applications is that commercial additives are often supplied in a carrier fluid, such as a mineral oil or an ester oil, which is more volatile than the additive and therefore undesirable for satellite applications. Further, most commercial additives are not made especially for vacuum operation, so the choice is limited. Commercial additive producers have little incentive to make less volatile additives for the satellite lubricant market because of its extremely small volume.

U.S. Pat. No. 5,196,130, issued Mar. 23, 1993 to L. J. Gschwender and C. E. Snyder, Jr, discloses a lubricity additive, tris(4-chlorophenoxyphenyl)phosphate, for high-temperature gas turbine engine oils. We have now found that this additive is also useful for satellite lubrication applications.

Accordingly, it is an object of the present invention to provide lubricants for satellite applications.

Other objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

DESCRIPTION OF THE INVENTION

In accordance with the present invention there are provided lubricants for satellite applications which consist essentially of a base fluid having low volatility and a minor amount, i.e., about 0.1 to 10 weight percent, of a chlorinated tris(phenoxyphenyl)phosphate. If long-term storage on earth, prior to use, is anticipated, a minor amount of an antioxidant may be added to the lubricants. In one aspect of the invention, there is provided a lubricating oil consisting essentially of a base fluid having low volatility and about 0.1 to 3.0 weight percent of a chlorinated tris(phenoxyphenyl) phosphate. In another aspect of the invention, there is provided a grease composition consisting essentially of a base fluid having low volatility, a suitable thickener and about 0.1 to 9.9 weight percent of a chlorinated tris (phenoxyphenyl)phosphate.

The base fluids, as noted previously, includes narrow molecular weight range polyalphaolefins (PAO), multiply alkylated cyclopentanes (MAC) and silahydrocarbons (SiHC). Commercially available polyalphaolefins may contain low molecular weight components which can be removed by vacuum distillation. For example, SHF-82, available commercially from Mobil Chemical Company, contains approximately 10% $C_{30}$, 35% $C_{40}$, and 55% $C_{50+}$. Distillation of this stock at 0.7 Pa (0.005 torr), 240° to 250° C., provides a "bottom cut" with a composition of about 6% $C_{40}$, balance $C_{50+}$.

The following example illustrates the invention:

EXAMPLE

The following fluids were tested to determine their suitability for use as lubricants for satellite applications:

| Designation | Type | Source | | Tradename |
|---|---|---|---|---|
| PAO-1 | polyalphaolefin | Nye Lubricants, Inc. | New Bedford, MA | Nye Synthetic Oil 179 |
| PAO-2* | polyalphaolefin | Mobil Chemical Company | Edison, NJ | SHF-82 |
| MAC | multiply alkylated cyclopentane | Nye Lubricants, Inc. | New Bedford, MA | Pennzane 2000 |
| SiHC-1 | silahydrocarbon | | | |
| SiHC-2 | silahydrocarbon | | | |
| SiHC-3 | silahydrocarbon | | | |

(distilled as noted previously

The fluids designated SiHC-1, -2 and -3 were synthesized in-house according to the procedure in Chen et al, U.S. patent application Ser. No. 09/385,397, filed Aug. 30, 1999. Briefly, the procedure comprises reacting an alkyl silane having the formula $H—SiR^1_3$ with a compound having at least one vinyl group of the formula $R_n—Si—(CH{=}CH_2)_{(4-n)}$, wherein R and $R^1$ are alkyl groups having 1 to 18 carbon atoms, and n is an integer having a value of 0 to 3, in the presence of a transition metal salt or transition metal complex catalyst. SiHC-1 has the formula $CH_3Si(CH_2CH_2Si—(n\text{-}C_{10}H_{21})_3)_3$, SiHC-2 has the formula $CH_3Si(CH_2CH_2Si—(n\text{-}C_8H_{17})_3)_3$, formula $CH_3Si(CH_2CH_2Si—(n\text{-}C_6H_{13})_3)_3$.

Viscosity, viscosity index and thermographic data for these fluids are shown in Table I, below:

TABLE I

| | PAO | | MAC | Silahydrocarbon | | |
|---|---|---|---|---|---|---|
| Fluid type | PAO-1 | PAO-2 | Penn-zane | SiHC-1 | SiHC-2 | SiHC-3 |
| Viscosity, cSt | | | | | | |
| 100° C. | 14.58 | 12.33 | 14.4 | 15.2 | 12.17 | 9.98 |
| 40° C. | 104 | 93.5 | 106 | 94.4 | 71.22 | 56.5 |
| −17.8° C. | 4860 | 5030 | 5158 | 3051 | 2059 | 1514 |
| −40° C. | * | * | 77870 | 34910 | 20780 | 14870 |
| −54° C. | * | * | * | * | 157300 | 110790 |
| Visc. Index | 145 | 126 | 139 | 170 | 169 | 165 |
| TGA T½, ° C. | 240 | 265 | 286 | 350 | 304 | 257 |
| TGA $T_0$, ° C. | 150 | 235 | 280 | 336 | 288 | 246 |
| $T_{½} - T_0$ | 90 | 30 | 6 | 14 | 16 | 11 |

*No Flow

In contrast, two commercial base fluids, Coray 100 and Vac-Kote, had $T_{1/2}$ of about 170° C. and 215° C., respectively; Fomblin Z, a fluid now used in spacecraft, has a $T_{1/2}$ of about 390° C.

Four-ball wear tests of formulations of these base fluids with chlorinated alkylated tris(phenoxyphenyl)phosphate were conducted in accordance with ASTM D4172 with the exception that a fitted plastic cage was placed around the apparatus and dry nitrogen was purged through the chamber for at least 15 minutes before and during the test. The calculated initial stress in this test is 4312 MPa (494,811 psi). Average wear scar data, in mm, are shown in Table II, below:

TABLE II

| | PAO | MAC | SiHC |
|---|---|---|---|
| Base Fluid | 1.8 | 2.7 | 1.6 |
| With Additive, % | 1.1, 1% | 2.2, 0.1%<br>0.55, 0.25% | 0.8, 1% |

Having thus described exemplary embodiments of the present invention, it should be noted by those skilled in the art that the disclosures herein are exemplary only and that alternatives, adaptations and modifications may be made within the scope of the present invention.

We claim:

1. A grease composition for satellite applications consisting essentially of a base fluid having low volatility, a suitable thickener and about 0.1 to 9.9 weight percent of a chlorinated tris(phenoxyphenyl)phosphate.

2. The grease composition of claim 1 wherein said base fluid is selected from the group consisting of polyalphaolefins, multiply alkylated cyclopentanes and silahydrocarbons.

3. A lubricating oil for satellite applications consisting essentially of a base fluid selected from the group consisting of polyalphaolefins, multiply alkylated cyclopentanes and silahydrocarbons and about 0.1 to 3.0 weight percent of a chlorinated tris(phenoxyphenyl)phosphate.

4. The lubricating oil of claim 3 wherein said base fluid is a polyalphaoefin and wherein the quantity of said phosphate is 1 weight percent.

5. The lubricating oil of claim 3 wherein said base fluid is a silahydrocarbon and wherein the quantity of said phosphate is 1 weight percent.

6. The lubricating oil of claim 3 wherein said base fluid is a multiply alkylated cyclopentane and wherein the quantity of said phosphate is about 0.1 to 0.25 weight percent.

* * * * *